US006918209B2

(12) United States Patent
Regnier et al.

(10) Patent No.: US 6,918,209 B2
(45) Date of Patent: Jul. 19, 2005

(54) WINDOW REGULATOR HAVING SPRING BIASED CABLE DRUMS

(75) Inventors: Luc R. Regnier, Toronto (CA); Denis R. Cloutier, Newmarket (CA)

(73) Assignee: Intier Automotive Closures, Inc., Newmarket (CA)

( * ) Notice: Subject to any disclaimer, the term of this patent is extended or adjusted under 35 U.S.C. 154(b) by 0 days.

(21) Appl. No.: 10/466,380

(22) PCT Filed: Jan. 21, 2002

(86) PCT No.: PCT/CA02/00081

§ 371 (c)(1),
(2), (4) Date: Jul. 16, 2003

(87) PCT Pub. No.: WO02/057581

PCT Pub. Date: Jul. 25, 2002

(65) Prior Publication Data

US 2004/0065018 A1 Apr. 8, 2004

Related U.S. Application Data

(60) Provisional application No. 60/263,034, filed on Jan. 19, 2001.

(51) Int. Cl.[7] ..... E05F 11/48
(52) U.S. Cl. ..... 49/352; 49/349
(58) Field of Search ..... 49/352, 349, 348, 49/374

(56) References Cited

U.S. PATENT DOCUMENTS 3,235,248 A * 2/1966 Golde ..... 74/89.18
3,280,509 A * 10/1966 Werner ..... 49/352
4,440,354 A * 4/1984 Kobayashi et al. ..... 242/388.8
4,534,233 A * 8/1985 Hamaguchi ..... 74/89.2
4,577,439 A * 3/1986 Seki ..... 49/352
4,628,759 A 12/1986 Kobayashi et al.
4,644,694 A 2/1987 Ujihara
4,840,080 A * 6/1989 Kobayashi et al. .... 74/501.5 R
5,047,077 A 9/1991 McMaster et al.
5,564,231 A * 10/1996 Tajima et al. ..... 49/352
5,857,635 A 1/1999 Klippert
6,052,946 A 4/2000 Isomura
6,052,947 A 4/2000 Smith
6,088,965 A 7/2000 Fukumoto et al.
6,256,929 B1 7/2001 Serrano et al.
6,430,873 B1 * 8/2002 Borchuk et al. ..... 49/352

FOREIGN PATENT DOCUMENTS

DE 197 38 795 C1 9/1997
FR 2 773 194 A3 12/1997
WO WO 00/35695 6/2000

* cited by examiner

*Primary Examiner*—Gregory J. Strimbu
(74) *Attorney, Agent, or Firm*—Clark Hill PLC

(57) ABSTRACT

A window regulator (10) for operating a window pane of vehicle comprises a base plate (12) having a guide rail (20). A lifter plate (26) is slidably coupled to the guide rail (20) and adapted for supporting the window pane. A motor assembly (32) is secured to the base plate (12) and includes a drive housing and a power motor. A drive shaft, rotatably journaled to the drive housing, has a disc flange supporting a cylindrical shaft and a key shaft spaced from and parallel to the cylindrical shaft. The top and bottom cable drums (34, 36) are supported on the drive shaft, with each of the cable drums including a key slot for aligning with and receiving the key shaft therethrough. The lifter plate is secured to a cable (38) between first and second pulleys (22, 24). At least one compression spring is coupled to one of the cable drums to maintain tension on the cable.

12 Claims, 7 Drawing Sheets

WINDOW REGULATOR HAVING SPRING BIASED CABLE DRUMS

This application claims benefit of Provisional appln. No. 60/263,034 dated Jan. 19, 2001.

FIELD OF THE INVENTION

This invention relates to a conduitless window regulator for a cable driven window lifter in an automotive vehicle which maintains tension in the cable during operation of the window regulator.

BACKGROUND OF THE INVENTION

Window regulators for a cable driven window lifter in an automotive vehicle commonly include a closed loop cable for transferring a force supplied by a motor to lift or lower a window pane. Opposing ends of the cable are secured to a cable drum and the cable is typically wound around the cable drum which is rotationally driven by the motor. The cable is also guided around upper and lower cable pulleys supported by opposing ends of a guide rail. A lifter is slidably coupled to the guide rail and attached to the cable between the upper and lower pulleys. The window pane is secured to the lifter such that the window pane is lifted or lowered by movement of the lifter along the guide rail between the upper and lower pulleys. This type of window regulator is disclosed in U.S. Pat. No. 5,047,077.

Window regulators also often incorporate means for compensating for cable slackness when the lifter is in a relaxed state; that is, not lifting or lowering the window pane. The U.S. Pat. No. 5,857,635 discloses a window regulator wherein one end of the cable is attached to a cable drum and the opposite end of the cable is attached to a conduit-like slide disposed inside the cable drum. When the cable is unloaded, a spring urges the slide rotationally about the cable drum to take up cable slackness. However, the slide does not maintain tension in the cable when the window pane is lifted or lowered by rotation of the cable drum.

SUMMARY OF THE INVENTION

According to one aspect of the invention, there is provided a window regulator for operating a window pane of an automotive vehicle comprising a base plate having a guide rail extending between opposite upper and lower ends. A lifter plate is slidably coupled to the guide rail and adapted for supporting the window pane. A motor assembly is secured to the base plate and includes a drive housing and a power motor. A drive shaft is rotatably journaled to the drive housing. The drive shaft has a support flange supporting a center shaft and a key shaft spaced from and parallel to the center shaft. A pair of cable drums are supported on the drive shaft, each of the cable drums including a key slot for aligning with and receiving the key shaft therethrough. A cable having a first end connected to one of the cable drums is at least partially wound around the drum in a first direction while a second end is connected to the other of the cable drums and at least partially wound around the other drum in a second direction opposite the first direction. The lifter plate is secured to the cable between the first and second ends. A compression spring is operatively engaged with each of the respective cable drums for engagement between the key shaft and the drums for biasing the drums in opposite directions and maintaining tension on the cable between the first and second ends.

BRIEF DESCRIPTION OF THE DRAWINGS

In drawings which illustrate embodiments of the present invention.

DETAILED DESCRIPTION OF THE INVENTION

Figure 1:
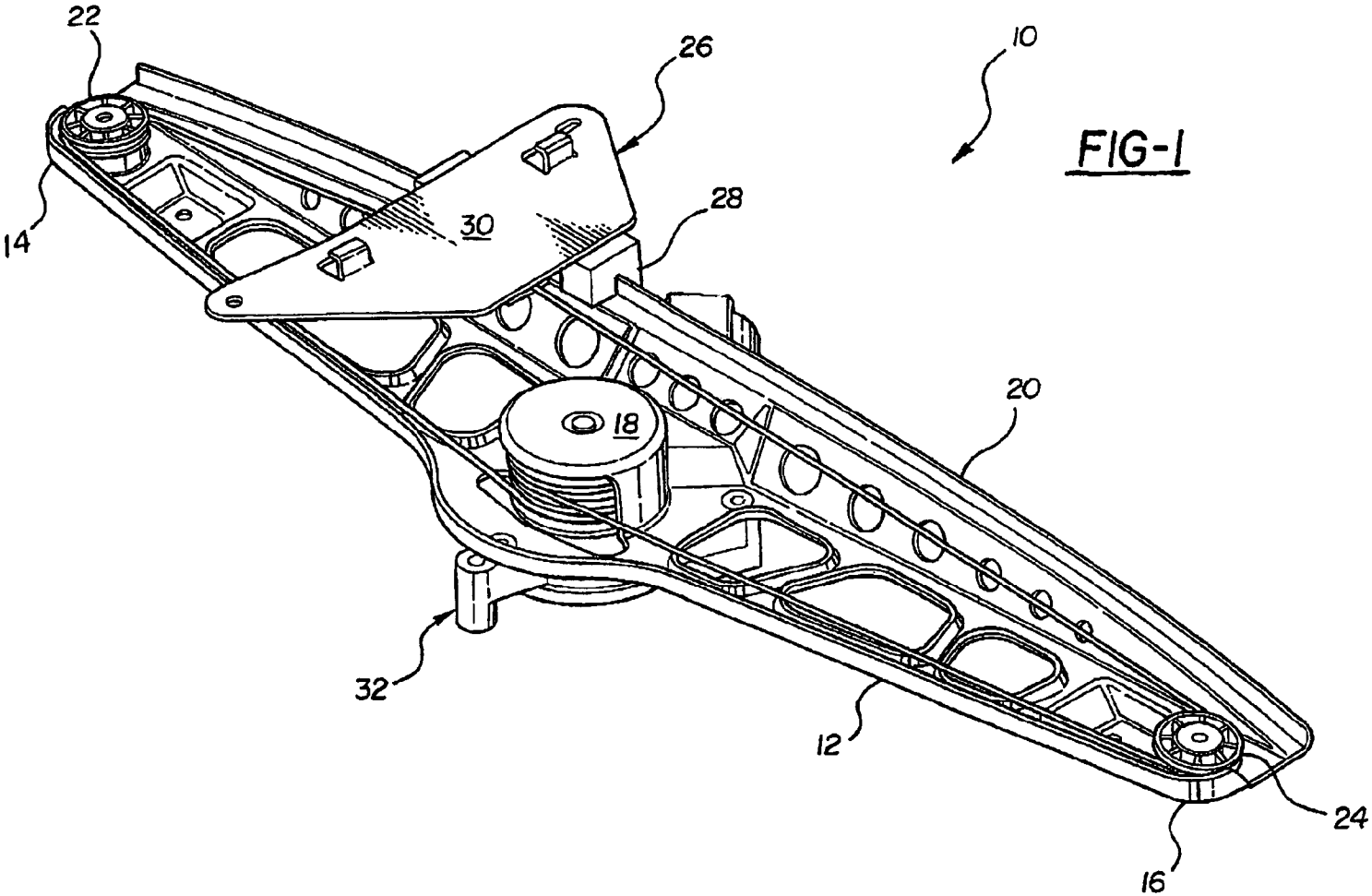
FIG. 1 is perspective view of the window regulator according to the subject invention.
Figure 2:
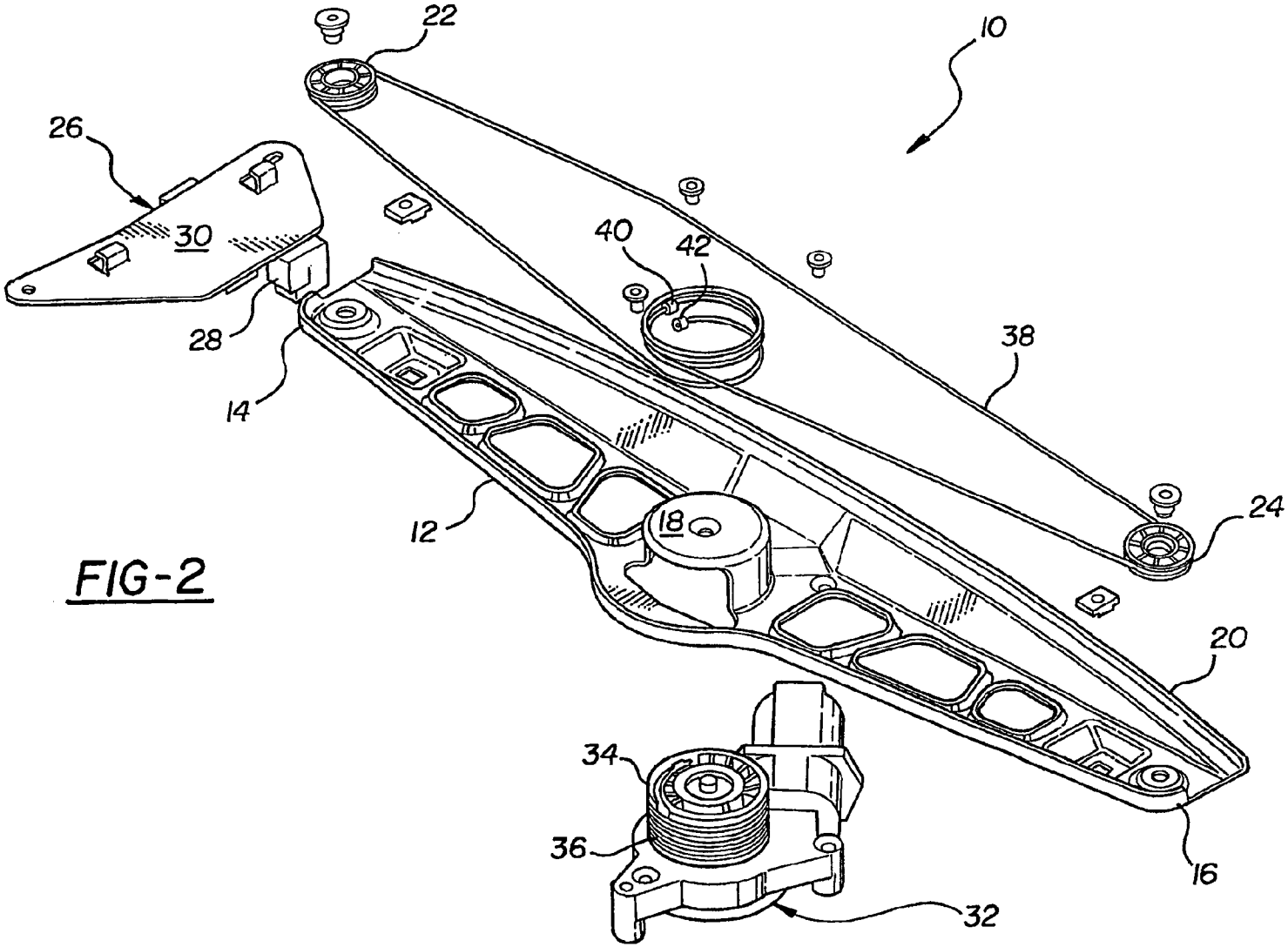
FIG. 2 is an exploded perspective view of FIG. 1.

Referring to FIGS. 1 and 2, the conduitless window regulator is generally illustrated at 10. The window regulator 10 includes an elongated base plate 12 extending between an upper end 14 and a lower end 16. A raised cylindrical housing 18 is centered between the upper and lower end 14, 16. The base plate 12 further includes a guide rail 20 extending between the upper and lower end 14, 16 adjacent the housing 18. An upper pulley 22 is rotatably secured to the upper end 14 and a lower pulley 24 is rotatably secured to the lower end 16 of the base plate 12.

The window regulator 10 further includes a lifter plate 26 having a slide block 28 slidably coupled to the guide rail 20 on the base plate 12 for movement therealong between the upper and lower ends 14, 16. A window support plate 30 is secured to the slide block 28 for securing and supporting a lower portion of a window pane of an automotive vehicle as is commonly known in the art.

The window regulator 10 also includes a motor assembly 32 secured to the base plate 12 in opposite facing relationship to the raised cylindrical housing 18. A pair of disc-like cable drums 34, 36 are seated within the housing 18 and in operative engagement with the motor 32 as will be further described hereinbelow. A cable 38 is provided having opposite first and second ends 40, 42 secured to the respective cable drums 34, 36. The cable 38 is wound around each of the upper and lower pulleys 22, 24 and the lifter plate 26 is fixedly secured to the cable 38 between the upper and lower pulleys 22, 24. Alternatively, the window regulator 10 may include a pair of cables, one of which is connected between the upper pulley 22 and the top of the lifter plate 26 and the other of which is connected between the lower pulley 24 and the bottom of the lifter plate 26. Each of the cables may be at least partially wound around the respective cable drums 34, 36 and function similar to that of the single cable 38.

The motor assembly 32 rotates the cable drums 34, 36 is either the clockwise or counterclockwise direction to pull on the cable 38 and move the lifter plate 26 between the upper and lower pulleys 22, 24 to lift or lower the window pane. The subject invention relates to the cable drums 34, 36 providing constant tension on the cable 38 during the lifting or lowering of the window pane and in a relaxed position, or pre-loaded state.

Figure 3:
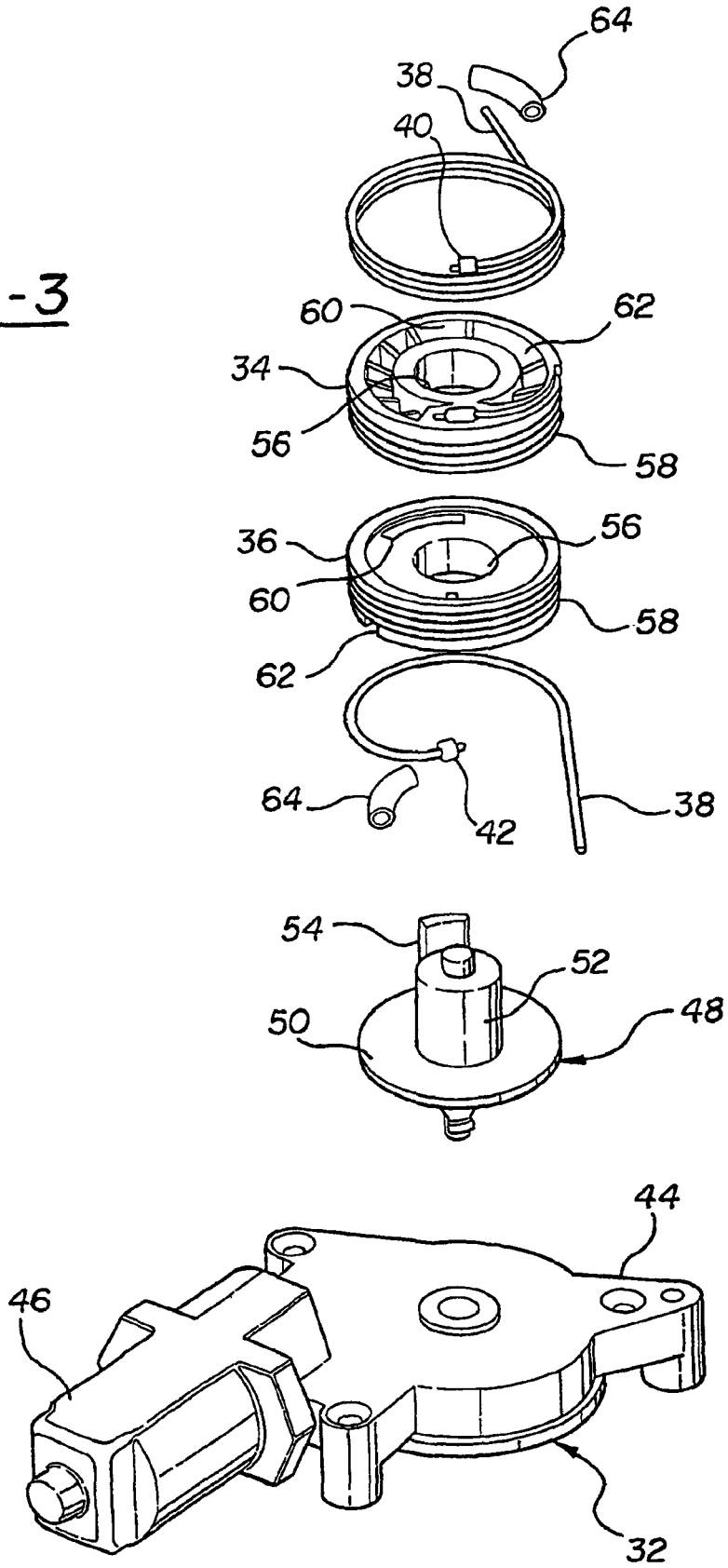
FIG. 3 is an exploded perspective view of the motor assembly and cable drums.

Specifically, referring to FIG. 3, the motor assembly 32 includes a drive housing 44 supporting a power motor 46. A drive shaft 48 is coupled to the drive housing 44 for rotation in both a clockwise and counterclockwise direction. The drive shaft 48 includes a disc-like support flange 50 for supporting the cable drums 34, 36, a cylindrical center shaft 52 projecting from the flange 50 and extending through the center of each of the cable drums 34, 36, and a key shaft 54 projecting from the perimeter of the flange 50 adjacent to and spaced from the shaft 52.

Each of the cable drums 34, 36 include a center bore 56 for receiving the shaft 52 and a series of helical outer perimeter grooves 58 for receiving and winding the cable 38 therearound. The cable drums 34, 36 are symmetrical, and therefore, further details of the top cable drum 34 will be described. The drum 34 includes a key slot 60 for receiving the key shaft 54 therethrough and a recessed spring pocket 62 for receiving and supporting a spring 64 compressed by the key shaft 54. The spring 64 in the embodiment of FIGS. 1–4 is a coil-type compression spring for placement within the spring pocket 62 of each of the top and bottom drums 34, 36. It should be appreciated, however, that other types of springs may be utilized. For example, a coiled leaf-type spring may be used which is seated about the shaft 52 and key 54 having free ends for engagement between the key and the end of the slot 60 to compress the spring and tension the cable 38.

Figure 4:
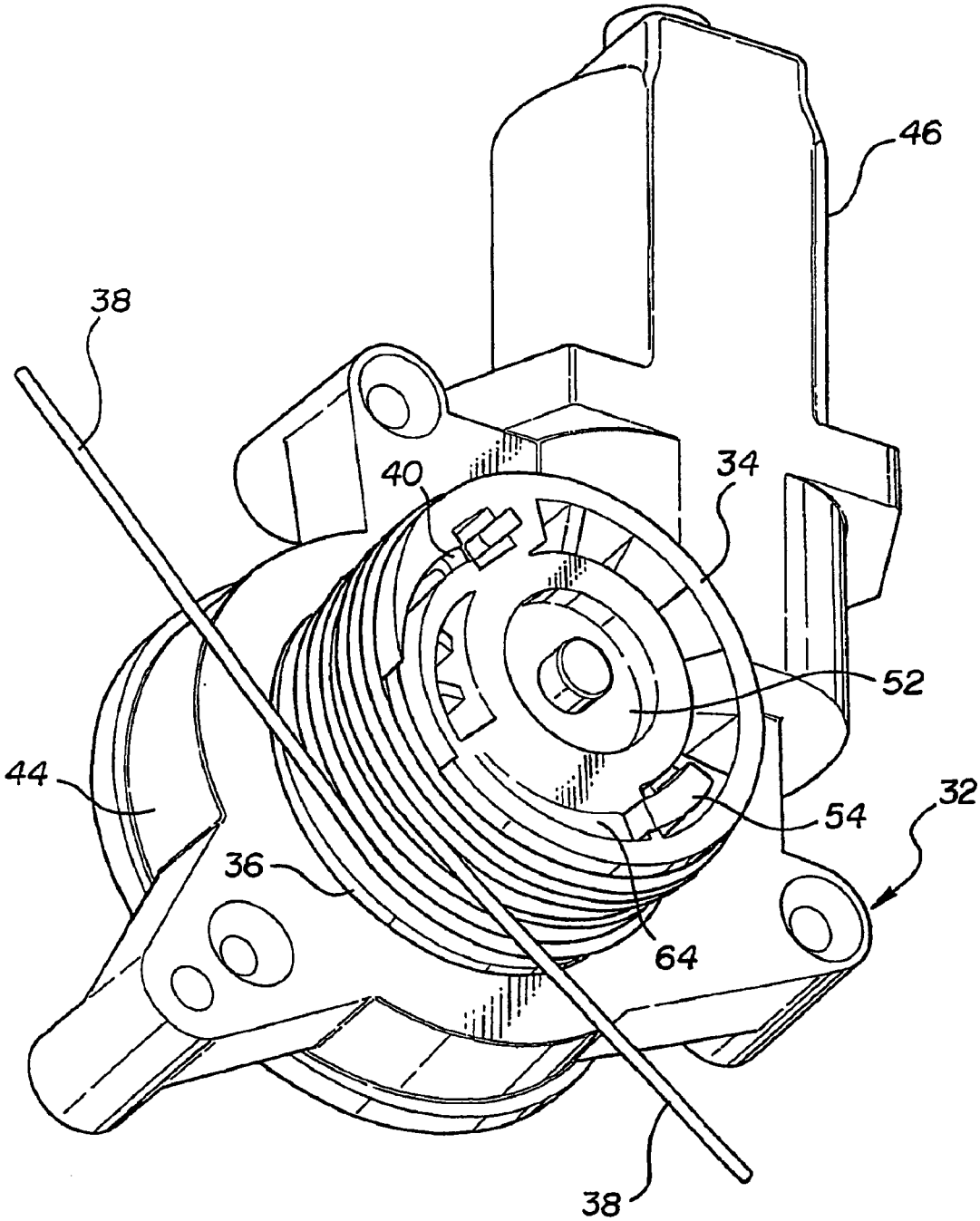
FIG. 4 is an assembled perspective view of FIG. 3.
Figure 5:
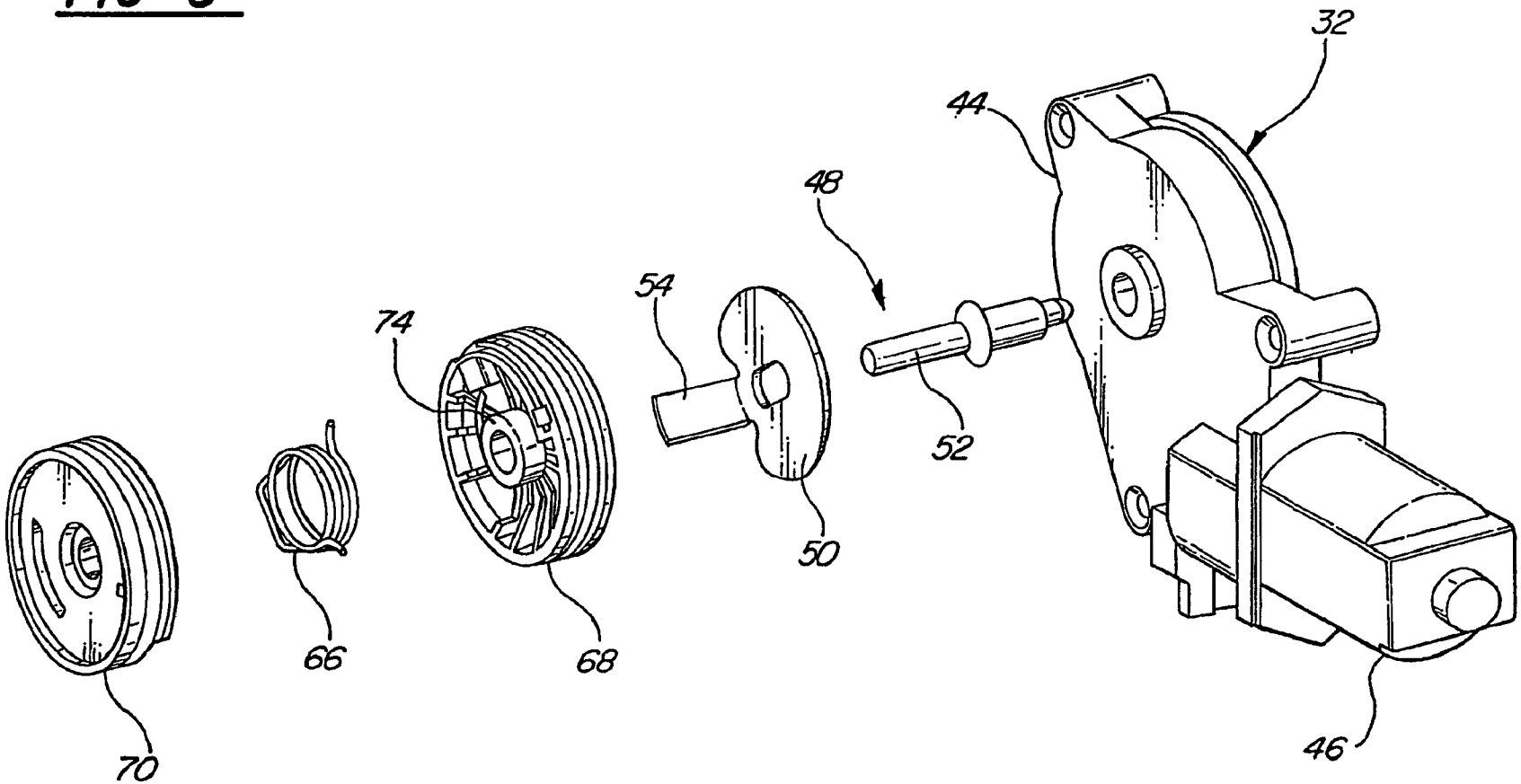
FIG. 5 is an exploded perspective view of an alternative embodiment of the window regulator.
Figure 6:
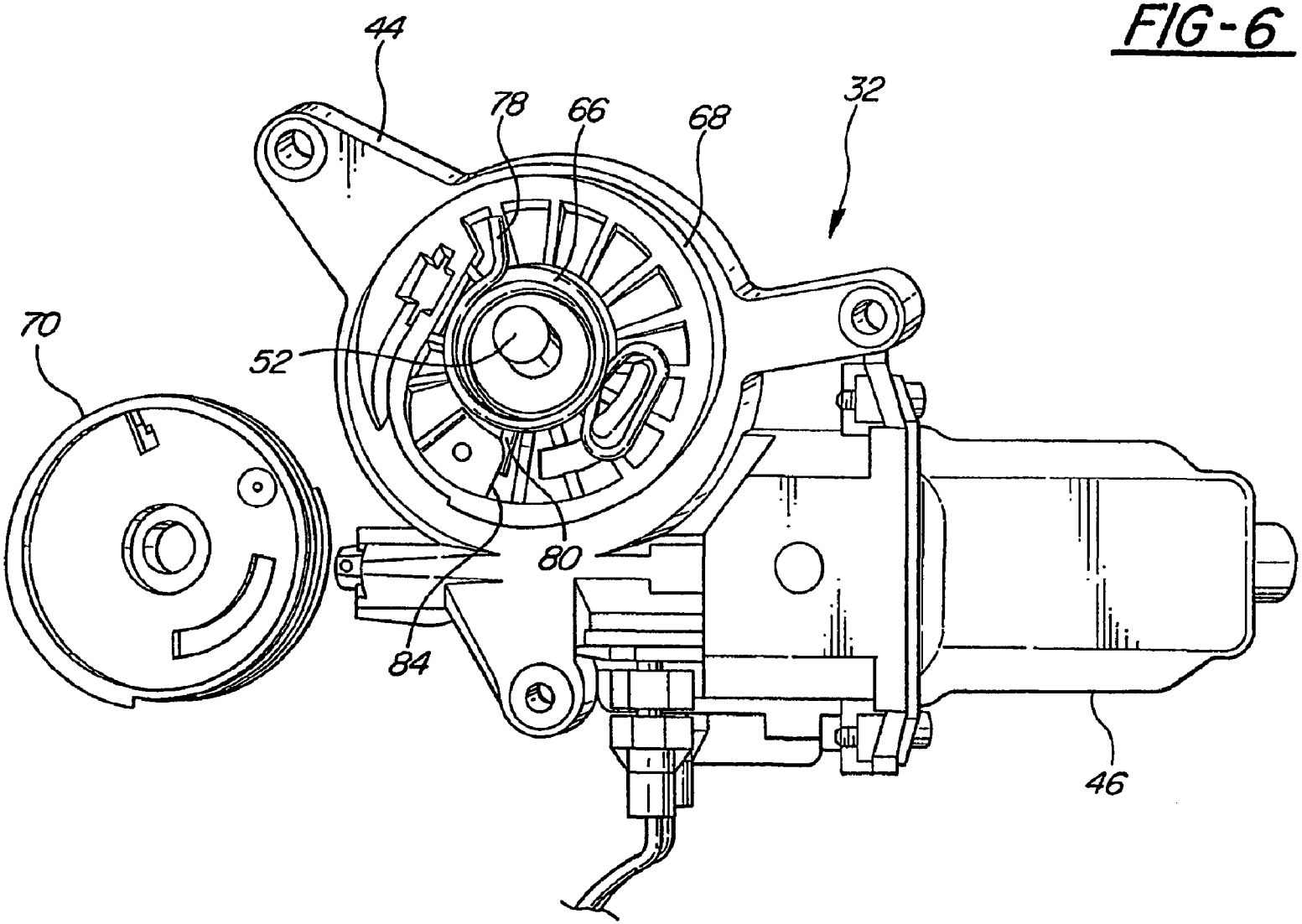
FIG. 6 is a top view of a partially assembled window regulator according to the alternative embodiment of the invention.
Figure 7:
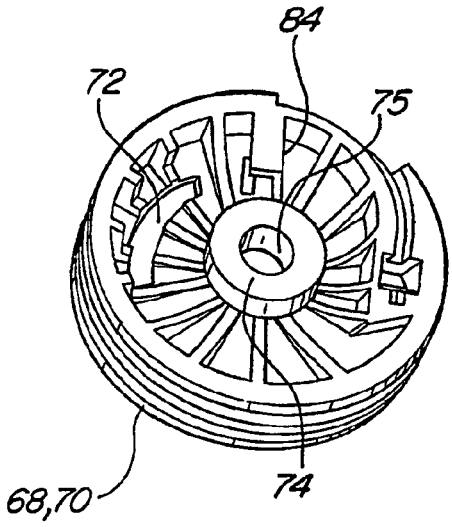
FIG. 7 is a perspective view of an alternative cable drum for use with the alternative embodiment of the invention.

The first end 40 of the cable 38 is fixedly secured to the top cable drum 34 and the cable 38 is partially wound around the drum 34 in a counterclockwise direction resting within the helical grooves 58. Similarly, the second end 42 of the cable 38 is fixedly secured to the bottom drum 36 and the cable 38 is partially wound around the drum 36 in a clockwise direction resting within the helical grooves 58. FIG. 4 discloses the cable drums 34, 36 and cable 38 assembled to the motor assembly 32.

In operation, during assembly, the compression springs 64 are placed into the spring pockets 62 of the respective top and bottom cable drums 34, 36. The bottom drum 36, with the cable 38 attached thereto, is placed on the shaft 52 with the spring 64 facing the shaft flange 50 and the key slot 60 aligned with the key shaft 54. The top drum 34, also with the cable 38 attached thereto, is then place on the shaft 52 with the spring 64 facing away from the flange 50 and the key slot 60 aligned with the key shaft 54. The drums 34, 36 are free to partially rotate on the shaft 52 approximately 2 mm due to a spaced created between the opposing sides of the key 54 and the springs 64. That is, the spring 64 of the bottom drum 36 is positioned slightly spaced from one side of the key 54 and the spring 64 of the top drum is positioned slightly spaced from the opposite side of the key 54.

In a pre-loaded state, with the window regulator 10 fully assembly as shown in FIG. 1, the lifter plate 26 is positioned midway along the guide rail 20 between the upper and lower pulleys 22, 24. The predetermined length of the cable 38 will cause the top and bottom drums 34, 36 to be positioned on the shaft 52 in such a way that the key shaft 54 is forced approximately 1–2 mm from the end of the slot 60 in the lower drum 36 and the spring 64 is fully compressed in the spring pocket 62. When the motor 46 is powered to rotate the drive shaft 48 in a clockwise direction, the key shaft 54 will engage and compress the spring 64 in the upper drum 34 until the key 54 contacts the end of the slot 60. The cable 38 winds around the drum 34 as it rotates and thus pulls the lifter plate 26 downwardly to lower the window pane. The bottom drum 36 maintains its pre-loaded state as it simultaneously rotates to maintain tension on the cable 38 while it unwinds from the bottom drum 36.

After the lifter plate 26 reaches the bottom of the rail 20, the motor 46 stops powering the drive shaft 48 and the drums 34, 36 are maintained in the current operating state. When the motor 46 is reversed to turn the drive shaft 48 and drums 34, 36 in the counterclockwise direction, the opposite movement of the key 54 with the drums 34, 36 occurs.

Referring to FIGS. 5–10, an alternative embodiment of the cable drums and compression spring is shown. The alternative embodiment includes a single compression spring 66 positioned between and operatively engaged with each of the cable drums 68, 70. Specifically, the first cable drum 68 is centered on the center drive shaft 52 and supported by the flange 50. The key shaft 54 is similarly received through a key slot 72 of the drum 68. The drum 68 includes a raised hub 74 surrounding its center bore 75 for receiving and supporting the compression spring 66. The second cable drum 70 is then centered on the center drive shaft 52 and supported by the first drum 68. The key shaft 54 is received through the key slot 72 of the second drum 70 and the spring 66 is seated on the raised hub 74 thereof such that the compression spring 66 is positioned between the drums 68, 70.

Figure 8:
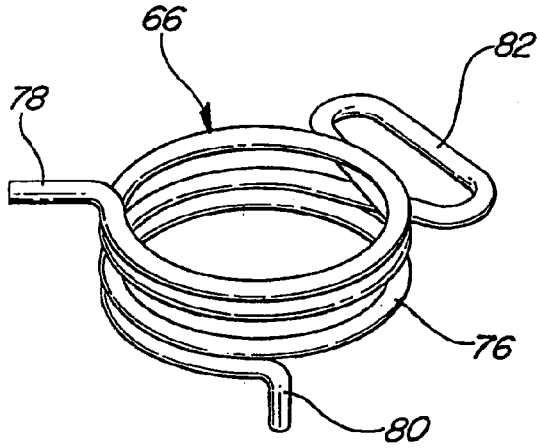
FIG. 8 is a perspective view of an alternative compression spring.
Figure 9:
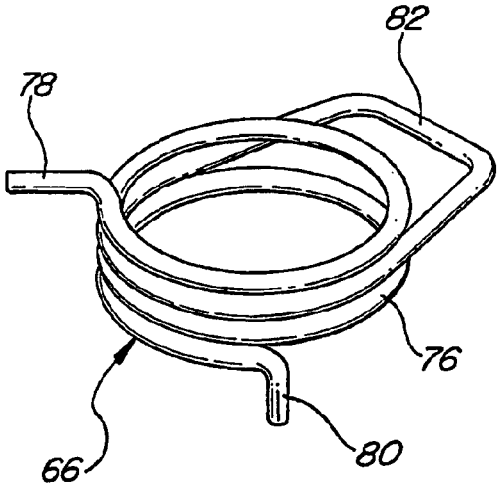
FIG. 9 is a perspective view of yet another alternative compression spring.
Figure 10:
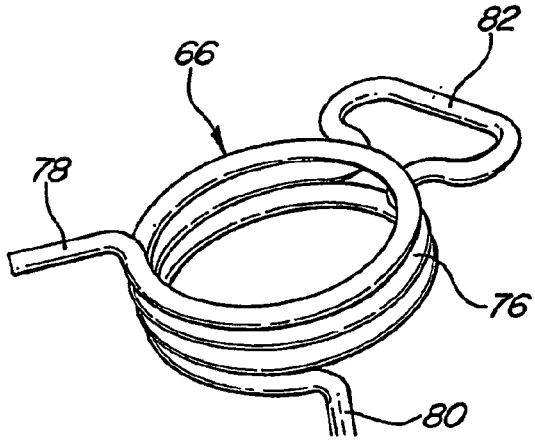
FIG. 10 is a perspective view of still another alternative compression spring.

Referring specifically to FIGS. 8–10, the compression spring 66 includes a cylindrical coil 76 terminating at upper and lower outwardly projection spring tabs 78, 80. A portion of the coil 76 forms a projecting loop 82 for receiving the key shaft 54 therethrough to prevent rotation of the spring 66 relative to the drums 68, 70. The loop 82 may be formed in varying configurations as desired and as shown in FIGS. 8–10.

Each of the drums 68, 70 further include a vertical blocking wall 84 for abutting with the respective upper and lower spring tabs 78, 80 and for biasing the drums 68, 70 in the respective clockwise and counterclockwise directions similar to the first embodiment to take up slack in the cable 38 wound around the drums 68, 70. The operation of the alternative embodiment is the same as the first embodiment, except a single coiled compression spring 66 is utilized between the first and second drums 68, 70 and keyed to the key shaft 54.

The above-described embodiment of the invention is intended to be an example of the present invention and alterations and modifications may be effected thereto, by those of skill in the art, without departing from the scope of the invention.

What is claimed is:

1. A window regulator for operating a window pane of an automotive vehicle comprising:

a base plate;

a lifter plate slidably coupled to said base plate for supporting the window pane;

a motor assembly secured to said base plate, said motor assembly including a drive housing and a power motor;

a drive shaft rotatably driven by said power motor, said drive shaft including a center shaft and a key shaft spaced therefrom;

a pair of cable drums received on said center shaft, each of said cable drums including a key slot aligning with and receiving said key shaft therethrough;

a cable having a first end connected to one of said cable drums and at least partially wound around said one of said cable drums in a first direction and a second end connected to said other of said cable drums and at least partially wound around said other drum in a second direction opposite said first direction, said lifter plate secured to said cable between said first and second ends; and at least one spring engaging said key shaft and said one of said drums to bias said one of mounted between said key shaft and one of said drums for said drums in a direction and maintain tension on said cable between said first and second ends.

2. A window regulator as set forth in claim 1 wherein said one of said drums includes a spring pocket for engaging at least a portion of said at least one spring to compress said spring between said key shaft and said one of said drums.

3. A window regulator as set forth in claim 2 wherein each of said drums includes a center bore for receiving said center shaft therethrough to mount said drums on said drive shaft.

4. A window regulator as set forth in claim 3 wherein each of said drums include a series of helical outer perimeter grooves for receiving and winding said cable around each of said drums in said opposite first and second directions.

5. A window regulator as set forth in claim 4 wherein said at least one spring comprises, a first spring seated in said spring pocket of said 0ne os said drums and compressed between said one of said drums and said key shaft and a second spring seated in a spring pocket of said other of said drums and compressed between said other of said drums and said key shaft during rotation of said cable drums.

6. A window regulator as set forth in claim 1 wherein each of said drums includes a raised hub surrounding said center bore.

7. A window regulator as set forth in claim 6 wherein said spring includes a coil seated around each of said raised hubs between said drums.

8. A window regulator as set forth in claim 7 wherein said coil terminates at spaced apart upper and lower outwardly projection spring tabs.

9. A window regulator as set forth in claim 8 wherein each of said first and second drums includes pocket forms a vertical wall for engaging a respective one of said spring tabs.

10. A window regulator as set forth in claim 9 wherein said coil forms a protecting loop for receiving said key shaft therethrough to prevent rotation of said spring relative to said drums.

11. A window regulator comprising:

a motor assembly including a drive housing and a power motor;

a drive shaft rotatably driven by said power motor, said drive shaft including a center shaft and a key shaft spaced therefrom;

a pair of cable drums each having a central bore receiving said center shaft and a key slot aligning with and receiving said key shaft therethrough;

a cable having a first end connected to one of said cable drums and at least partially wound around said one of said cable drums in a first direction and a second end connected to said other of said cable drums and at least partially wound around said other drum in a second direction opposite said first direction; and a coiled spring mounted between said cable drums about said center shaft, said spring having a loop formed therein receiving said key shaft and projecting spring tabs abutting said drums for biasing said drums in opposite directions and maintaining tension on said cable between said first and second ends.

12. A window regulator comprising:

a motor assembly including a drive housing and a power motor:

a drive shaft rotatably driven by said power motor, said drive shaft including a center shaft and a key shaft spaced therefrom;

first and second cable drums received on said center shaft, each of said cable drums including a key slot aligning with and receiving said key shaft therethrough and a spring pocket;

a cable having a first end connected to one of said cable drums and at least partially wound around said one of said cable drums in a first direction and a second end connected to said other of said cable drums and at least partially wound around said other drum in a second direction opposite said first direction; and a first compression spring mounted in said spring pocket of said first cable drum so as to engage said key shaft on a first side of said key shaft and a second compression spring mounted in said spring pocket of said cable drum so at to engage said key shaft on an opposite second side of said key shaft.

* * * * *

UNITED STATES PATENT AND TRADEMARK OFFICE

CERTIFICATE OF CORRECTION

PATENT NO. : 6,918,209 B2
APPLICATION NO. : 10/466380
DATED : July 19, 2005
INVENTOR(S) : Luc R. Regnier et al.

It is certified that error appears in the above-identified patent and that said Letters Patent is hereby corrected as shown below:

Col. 5, in claim 1, last paragraph should read as follows:

...at least one spring [engaging] <u>mounted between said key shaft</u> and said one of said drums <u>for engaging said key shaft and said one of said drums</u> to bias said one of [mounted between said key shaft and one of said drums for] said drums in a direction and maintain tension on said cable between said first and second ends.

In claim 5, line 2, please delete the comma after "comprises".

In claim 5, line 3, please delete "0ne os" and substitute therefor, --one of--.

In claim 12, line 3, please delete ":" after the word "motor" and substitute therefor, --;--.

In claim 12, second to last line, please delete "so at" and substitute therefor, --so as--.

Signed and Sealed this

Fifteenth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 6,918,209 B2
APPLICATION NO. : 10/466380
DATED : July 19, 2005
INVENTOR(S) : Luc R. Regnier et al.

It is certified that error appears in the above-identified patent and that said Letters Patent is hereby corrected as shown below:

Col. 5, in claim 1, lines 1-5, last paragraph should read as follows:

...at least one spring [engaging] <u>mounted between said key shaft</u> and said one of said drums <u>for engaging said key shaft and said one of said drums</u> to bias said one of [mounted between said key shaft and one of said drums for] said drums in a direction and maintain tension on said cable between said first and second ends.

Column 5, in claim 5, line 18, please delete the comma after "comprises".

Column 5, in claim 5, line 19, please delete "0ne os" and substitute therefor, --one of--.

Column 6, in claim 12, line 21, please delete ":" after the word "motor" and substitute therefor, --;--.

Column 6, in claim 12, line 40 , please delete "so at" and substitute therefor, --so as--.

This certificate supersedes the Certificate of Correction issued July 15, 2008.

Signed and Sealed this

Fifth Day of August, 2008

JON W. DUDAS
*Director of the United States Patent and Trademark Office*